US010060625B2

(12) United States Patent
Abe et al.

(10) Patent No.: US 10,060,625 B2
(45) Date of Patent: Aug. 28, 2018

(54) GAS TURBINE COMBUSTOR

(71) Applicant: Mitsubishi Hitachi Power Systems, Ltd., Nishi-ku, Yokohama (JP)

(72) Inventors: Kazuki Abe, Yokohama (JP); Tomomi Koganezawa, Yokohama (JP); Keisuke Miura, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 299 days.

(21) Appl. No.: 14/772,535

(22) PCT Filed: Mar. 13, 2013

(86) PCT No.: PCT/JP2013/056905
§ 371 (c)(1),
(2) Date: Sep. 3, 2015

(87) PCT Pub. No.: WO2014/141397
PCT Pub. Date: Sep. 18, 2014

(65) Prior Publication Data
US 2016/0010864 A1 Jan. 14, 2016

(51) Int. Cl.
*F23R 3/12* (2006.01)
*F23R 3/32* (2006.01)
(Continued)

(52) U.S. Cl.
CPC ..... *F23R 3/12* (2013.01); *F23R 3/28* (2013.01); *F23R 3/286* (2013.01); *F23R 3/30* (2013.01);
(Continued)

(58) Field of Classification Search
CPC .... F23R 3/12; F23R 3/28; F23R 3/286; F23R 3/30; F23R 3/32; F23R 3/343; F23R 3/346
See application file for complete search history.

(56) References Cited

U.S. PATENT DOCUMENTS 4,100,733 A * 7/1978 Striebel ..... F23R 3/286 239/419.3
5,927,076 A 7/1999 Pillsbury
(Continued)

FOREIGN PATENT DOCUMENTS

CN 1157563 C 7/2004
CN 101726003 A 6/2010
(Continued)

OTHER PUBLICATIONS

Chinese Office Action issued in counterpart Chinese Application No. 201380074598.2 dated Jul. 6, 2016 (fourteen (14) pages).
(Continued)

*Primary Examiner* — Steven Sutherland
(74) *Attorney, Agent, or Firm* — Crowell & Moring LLP

(57) ABSTRACT

In a perforated coaxial jet burner implemented by a lot of air-fuel coaxial jets, a swirl plate (33) as an end face of the burner on the combustion chamber's side has a lot of air holes for supplying unburned premixed gas of fuel and air to the combustion chamber. Grooves (36) are formed downstream of the air holes of the swirl plate. Adhesion of flame to the swirl plate is inhibited by feeding part of the unburned premixed gas to the grooves. Further, the width of each remaining part (37) between adjacent grooves is set at several millimeters that is approximately equal to the flame quenching distance, by which adhesion of flame to the remaining parts is also prevented. With this configuration, both stable combustion and low NOx combustion can be achieved irrespective of the load condition.

7 Claims, 16 Drawing Sheets

(51) Int. Cl.

| | |
|---|---|
| ***F23R 3/30*** | (2006.01) |
| ***F23R 3/28*** | (2006.01) |
| ***F23R 3/34*** | (2006.01) |

(52) U.S. Cl.
CPC ..... *F23R 3/32* (2013.01); *F23R 3/343* (2013.01); *F23R 3/346* (2013.01)

(56) References Cited

U.S. PATENT DOCUMENTS

| | | | | |
|---|---|---|---|---|
| 2004/0000146 | A1 | 1/2004 | Inoue et al. | |
| 2005/0000222 | A1 | 1/2005 | Inoue et al. | |
| 2008/0268387 | A1* | 10/2008 | Saito | F23R 3/286 431/8 |
| 2009/0293484 | A1* | 12/2009 | Inoue | F23R 3/286 60/740 |
| 2010/0107641 | A1 | 5/2010 | Bathina et al. | |
| 2010/0199675 | A1 | 8/2010 | Dinu et al. | |
| 2010/0236247 | A1 | 9/2010 | Davis, Jr. et al. | |
| 2010/0251725 | A1* | 10/2010 | Dodo | F23R 3/286 60/772 |
| 2012/0006030 | A1 | 1/2012 | Uhm et al. | |
| 2012/0036856 | A1 | 2/2012 | Uhm et al. | |

FOREIGN PATENT DOCUMENTS

| | | | |
|---|---|---|---|
| CN | 101839487 | A | 9/2010 |
| CN | 101839497 | A | 9/2010 |
| CN | 201817505 | U | 5/2011 |
| EP | 2 236 931 | A2 | 10/2010 |
| JP | 10-132278 | A | 5/1998 |
| JP | 2005-106305 | A | 4/2005 |
| JP | 3960166 | B2 | 8/2007 |
| JP | 2008-144671 | A | 6/2008 |
| JP | 2008-292138 | A | 12/2008 |
| JP | 2009-8335 | A | 1/2009 |
| JP | 2009-287910 | A | 12/2009 |
| JP | 2010-274311 | A | 12/2010 |
| JP | 4838107 | B2 | 12/2011 |

OTHER PUBLICATIONS

Extended European Search Report issued in counterpart European Application No. 13877469.0 dated Oct. 14, 2016 (seven (7) pages).
International Search Report dated May 14, 2013 with English translation (Four (4) pages).
International Preliminary Report on Patentability (PCT/IB/338 & PCT/IB/373) dated Sep. 24, 2015 with Written Opinion (PCT/ISA/237) (Eight (8) pages).

* cited by examiner

GAS TURBINE COMBUSTOR

TECHNICAL FIELD

The present invention relates to a gas turbine combustor.

BACKGROUND ART

Regulations and social demands for environmental conservation are intensifying day by day and still further efficiency improvement and NOx reduction are being required today also in the field of gas turbines. As a method for increasing the efficiency of a gas turbine, it is possible to increase the gas temperature at the inlet of the turbine. In this case, however, there is an apprehension that the amount of NOx emission increases with the increase in the flame temperature in the gas turbine combustor.

There exist gas turbine combustors employing premix combustion in order to reduce the NOx emission. The premix combustion is a combustion method in which air-fuel mixture obtained by previously mixing fuel and air together (premixed gas) is supplied to the gas turbine combustor and burned. Such a gas turbine combustor employing the premix combustion comprises a burner which has a premixer for previously conducting the mixing of fuel and air and a combustion chamber which is arranged downstream of the burner to burn the air-fuel mixture. The premix combustion is effective for the NOx reduction since the flame temperature is uniformized by the premix combustion. However, the possibility of flashback (flame unexpectedly flowing back to the premixer) increases since the combustion speed increases with the increase in the air temperature or in the hydrogen content in the fuel. Thus, there is an increasing demand for a gas turbine combustor achieving both NOx emission reduction and flashback resistance.

In regard to such a gas turbine combustor achieving both NOx emission reduction and flashback resistance, Japanese Patent No. 3960166 discloses a technology of a gas turbine combustor comprising a perforated coaxial burner which includes multiple fuel nozzles and multiple air holes arranged coaxially and supplies multiple coaxial jets of fuel and air (air-fuel coaxial jets) to the combustion chamber to cause combustion. The gas turbine combustor disclosed in the Document can achieve both NOx emission reduction and flashback resistance since the gas turbine combustor is capable of rapidly mixing fuel and air together in an extremely short distance compared to gas turbine combustors employing conventional premix combustion methods. Further, while fuels of high hydrogen content and high combustion speed (coal gasification gas, coke oven gas, etc.) have been handled so far by means of diffusion combustion, the gas turbine combustor disclosed in the Document is applicable also to this type of fuels.

Japanese Patent No. 4838107 discloses a structure in which a plurality of air-fuel coaxial jets are arranged in multiple concentric circular patterns (rows) around the center of the burner. In this structure, the plurality of air-fuel coaxial jets are grouped into multiple concentric circular groups. This method, increasing and decreasing the number of coaxial jets (supplying the fuel) in regard to the radial direction according to the increase/decrease in the load on the gas turbine, is called "fuel staging".

PRIOR ART DOCUMENT

Patent Document

Patent Document 1: JP 3960166 B2
Patent Document 2: JP 4838107 B2

SUMMARY OF THE INVENTION

Problem to be Solved by the Invention

The burner disclosed in Japanese Patent No. 4838107 is capable of achieving combustion stability and low NOx combustion at the same time since the central part of the burner secures combustion stability by forming a swirl flow and the peripheral part of the burner performs low NOx combustion by means of lean combustion.

However, the flow rates of air and fuel can fluctuate due to external disturbance such as a sudden change in the operating condition of the gas turbine, and an increase in the fuel flow rate is expected to lead to an increase in the fuel concentration and the combustion speed in the peripheral part of the burner. In such cases, the flame can cyclically repeat approaching and separating from the burner and fall into unstable combustion. The unstable combustion not only deteriorates the performance of the gas turbine but also can have an adverse influence on the structure.

It is therefore the primary object of the present invention to provide a gas turbine combustor of the premix combustion type capable of achieving both stable combustion in the central part of the burner and low NOx combustion in the peripheral part of the burner.

Means for Solving the Problem

To achieve the above object, a gas turbine combustor in accordance with the present invention comprises: a combustion chamber in which fuel is burned with air to generate combustion gas; a fuel header provided with a plurality of fuel nozzles for discharging fuel; an air hole plate formed with a plurality of air holes through which fuel discharged from the fuel nozzles and air are injected into the combustion chamber; and a groove formed on a surface of the air hole plate on the combustion chamber's side, the groove being connected with the air holes.

Effect of the Invention

According to the present invention, it becomes possible to achieve both stable combustion in the central part of the burner and low NOx combustion in the peripheral part of the burner.

MODES FOR CARRYING OUT THE INVENTION

Figure 1:
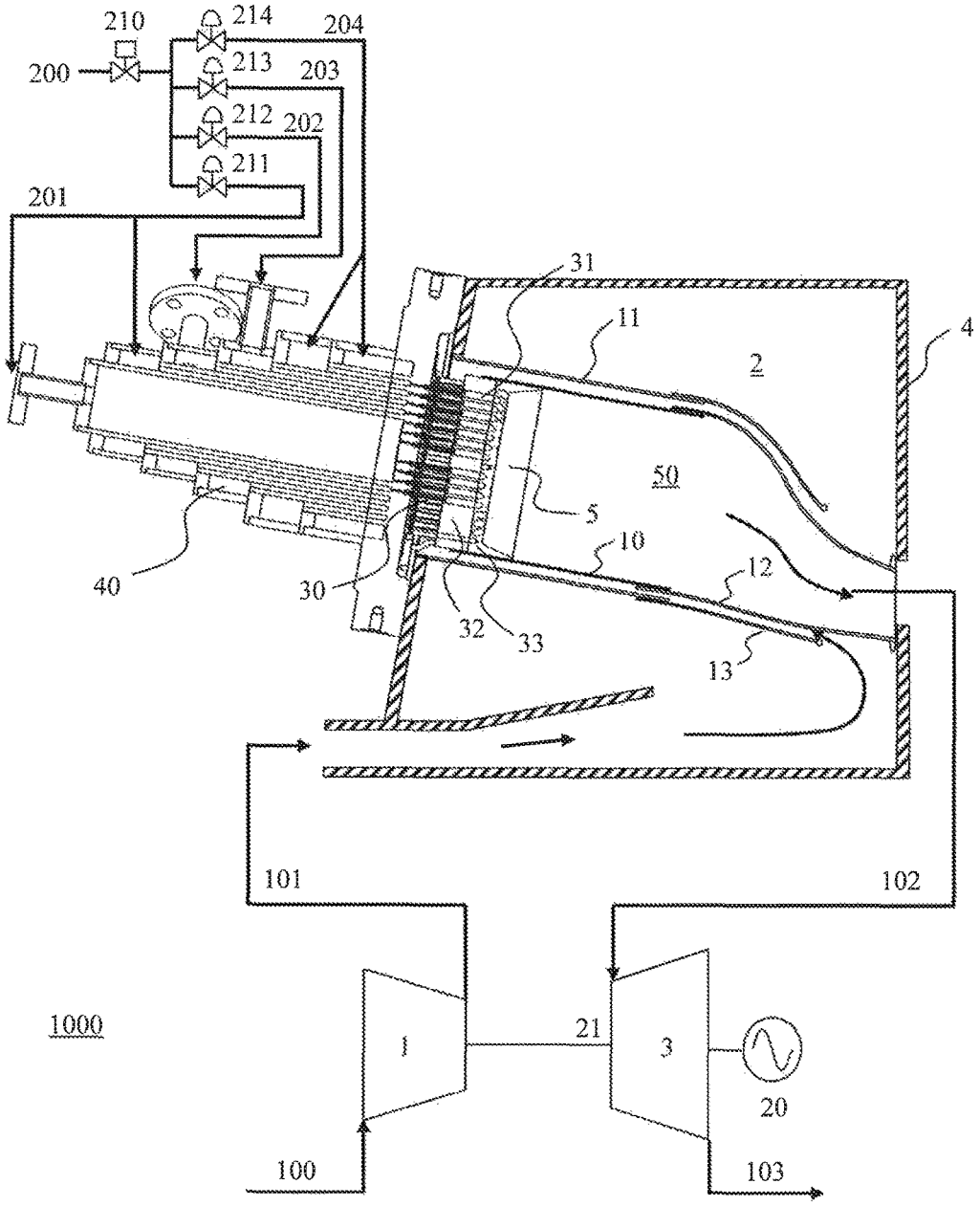
FIG. 1 is a schematic diagram showing the overall configuration of a gas turbine plant 1000 for power generation comprising a gas turbine combustor 2 in accordance with a first embodiment of the present invention.

Referring now to the drawings, a description will be given in detail of preferred embodiments of the present invention.

(1) First Embodiment

First, a gas turbine plant comprising a gas turbine combustor in accordance with a first embodiment of the present invention will be descried below by referring to FIG. 1. The gas turbine combustor in accordance with the first embodiment of the present invention comprises: multiple burners which mix fuel and air together and inject the air-fuel mixture into a combustion chamber to cause combustion; a fuel header in which a plurality of fuel nozzles for discharging the fuel are arranged; an air hole plate formed with a plurality of air holes for mixing the fuel and the air together and injecting the air-fuel mixture into the combustion chamber are formed; and a plurality of air-fuel coaxial jets formed by coaxially arranging the fuel nozzles and the air holes. Grooves in which part of the unburned premixed gas supplied from the air holes to the combustion chamber flows are formed downstream of the air holes. The thickness of a remaining wall between the grooves is approximately several millimeters.

FIG. 1 shows the overall configuration of a power generation gas turbine plant 1000 having the gas turbine combustor 2 in accordance with the first embodiment of the present invention. The power generation gas turbine plant 1000 shown in FIG. 1 comprises a compressor 1, a gas turbine combustor 2, a turbine 3 and a generator 20. The compressor 1 compresses intake air 100 and thereby generates high-pressure air 101. The gas turbine combustor 2 mixes the fuel supplied through a fuel system 200 with the high-pressure air 101 generated by the compressor 1, combusts the air-fuel mixture, and thereby generates high-temperature combustion gas 102. The turbine 3 is driven by the high-temperature combustion gas 102 generated by the gas turbine combustor 2. The generator 20 is driven and rotated by the turbine 3 and generates electric power.

The compressor 1, the turbine 3 and the generator 20 are linked together by an integral shaft 21. Drive force obtained by driving the turbine 3 is transmitted to the compressor 1 and the generator 20 via the shaft 21.

The gas turbine combustor 2 is stored in the casing 4 of a gas turbine unit. The gas turbine combustor 2 has a burner 5. A combustor liner 10 in a substantially cylindrical shape for separating the high-temperature combustion gas 102 generated by the gas turbine combustor 2 from the high-pressure air 101 supplied from the compressor 1 is arranged in the gas turbine combustor 2 downstream of the burner 5.

Arranged outside the combustor liner 10 is a flow sleeve 11 which servers as a peripheral wall forming an air channel for letting the high-pressure air 101 flow downstream from the compressor 1 to the gas turbine combustor 2. The flow sleeve 11, having a greater diameter than the combustor liner 10, is formed in a cylindrical shape substantially concentric with the combustor liner 10.

In a combustion chamber 50 formed inside the combustor liner 10, the air-fuel mixture of the high-pressure air 101 discharged from the burner 5 and the fuel supplied through the fuel system 200 is combusted. An inner tail tube 12 for leading the high-temperature combustion gas 102 generated in the combustion chamber 50 to the turbine 3 is attached to an end of the combustor liner 10 farther from the burner 5 (end on the downstream side in the circulation direction of the high-temperature combustion gas 102). An outer tail tube 13 is arranged outside the inner tail tube 12 via a predetermined interval.

Air hole plates 32 and 33, as substantially disc-shaped plates arranged coaxially with the central axis of the combustor liner 10 and constituting a wall of the combustion chamber 50 on the burner 5's side, are attached to an end of the combustor liner 10 on the burner 5's side (end on the upstream side in the circulation direction of the high-temperature combustion gas 102). The air hole plates are made up of a base plate 32 and a swirl plate 33 each having a plurality of air holes 31. The swirl plate 33 is arranged to face the combustion chamber 50 formed inside the combustor liner 10.

The intake air 100 turns into the high-pressure air 101 by being compressed by the compressor 1. The high-pressure air 101 is supplied to casing 4, fills the inside of the casing 4, thereafter flows into the space formed between the inner tail tube 12 and the outer tail tube 13, and cools down the inner tail tube 12 from its outer surface by means of convection cooling. The high-pressure air 101 which has flowed downstream through the space between the inner tail tube 12 and the outer tail tube 13 further flows downstream toward the gas turbine combustor 2 through an annular channel formed between the flow sleeve 11 and the combustor liner 10. In the middle of flowing downstream, the high-pressure air 101 is used for convection cooling of the combustor liner 10 arranged in the gas turbine combustor 2.

Part of the high-pressure air 101 flowing downstream through the annular channel formed between the flow sleeve 11 and the combustor liner 10 flows into the inside of the combustor liner 10 via a lot of cooling holes formed on the wall of the combustor liner 10 and is used for the film cooling of the combustor liner 10. The remaining high-pressure air 101 that flowed downstream through the annular channel without being used for the film cooling of the combustor liner 10 is supplied to the inside of the combustor liner 10 as combustion air via a great number of air holes 31 of the burner 5 provided for the gas turbine combustor 2.

The burner 5 is supplied with the fuel from four fuel systems: an F1 fuel system 201 having an F1 fuel flow control valve 211; an F2 fuel system 202 having an F2 fuel flow control valve 212; an F3 fuel system 203 having an F3 fuel flow control valve 213; and an F4 fuel system 204 having an F4 fuel flow control valve 214. In the example shown in FIG. 1, the four fuel systems 201, 202, 203 and 204 branch out from the fuel system 200 having a fuel shut-off valve (switching valve) 210.

The fuel supplied from the four fuel systems 201, 202, 203 and 204 is introduced into a header 40 (which is partitioned into four rooms differing in the radial distance from the central axis of the combustor liner 10) and is discharged from the header 40 through fuel nozzles 30.

The flow rate of F1 fuel supplied to the burner 5 through the F1 fuel system 201 is regulated by the F1 fuel flow control valve 211. The flow rate of F2 fuel supplied to the burner 5 through the F2 fuel system 202 is regulated by the F2 fuel flow control valve 212. The flow rate of F3 fuel supplied to the burner 5 through the F3 fuel system 203 is regulated by the F3 fuel flow control valve 213. The flow rate of F4 fuel supplied to the burner 5 through the F4 fuel system 204 is regulated by the F4 fuel flow control valve 214. The amount of power generation by the gas turbine plant 1000 is controlled by regulating the fuel flow rates of the F1 fuel, the F2 fuel, the F3 fuel and the F4 fuel with the fuel flow control valves 211, 212, 213 and 214, respectively.

Figure 2:
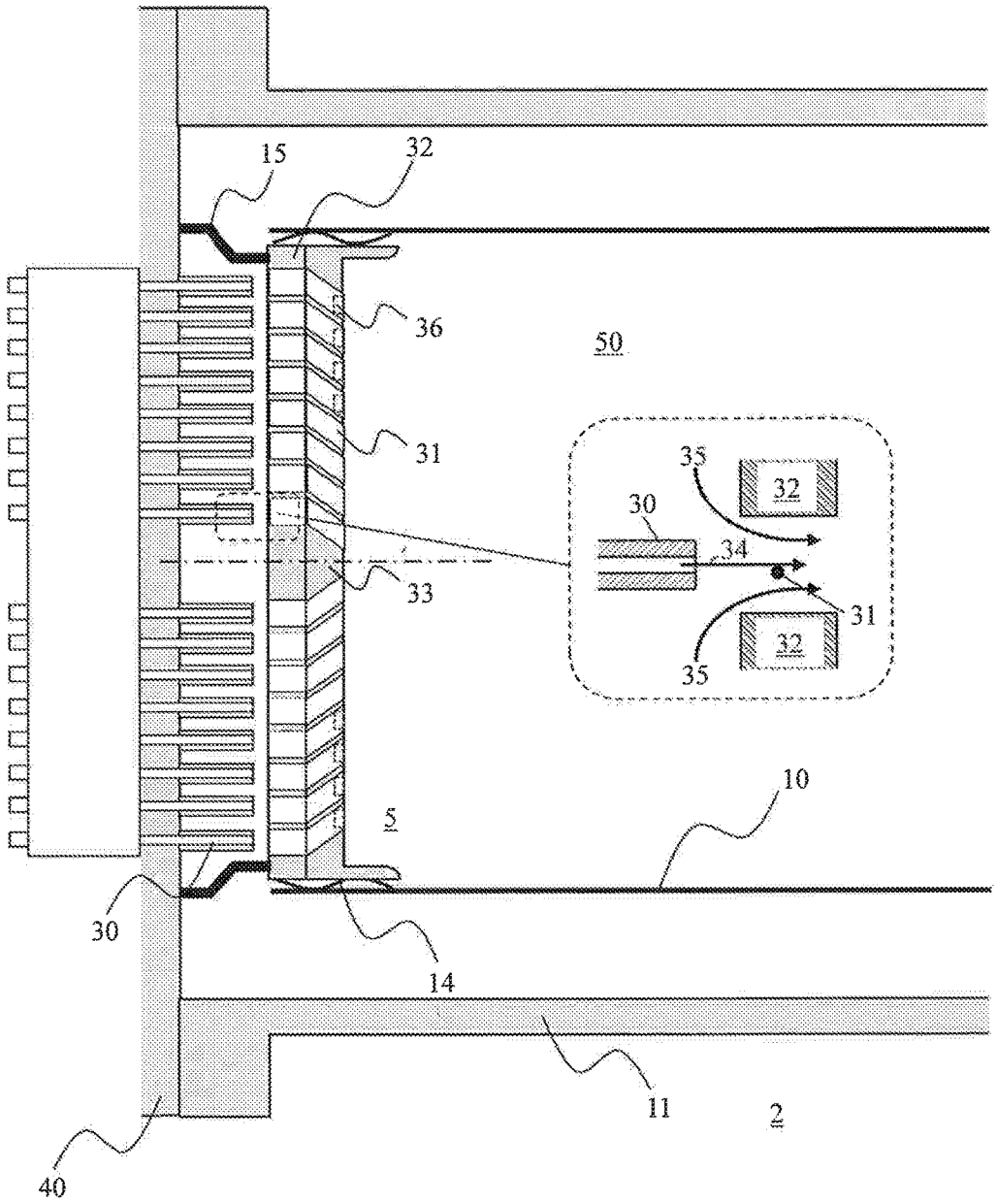
FIG. 2 is a partial structural drawing showing the details of the arrangement of fuel nozzles 30, a base plate 32 and a swirl plate 33 constituting a burner 5 of the gas turbine combustor 2 shown in FIG. 1.
Figure 3:
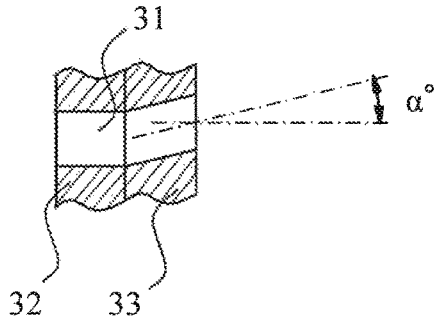
FIG. 3 is an enlarged view magnifying the base plate 32 and the swirl plate 33 shown in FIG. 2.

Next, the detailed configuration of the gas turbine combustor 2 will be explained below. FIG. 2 is a partial structural drawing showing the details of the arrangement of the fuel nozzles 30, the base plate 32 and the swirl plate 33 constituting the burner 5 of the gas turbine combustor 2 shown in FIG. 1. Specifically, FIG. 2 is a cross-sectional view taken along a line A-A' in FIG. 4 which will be explained later. FIG. 3 is an enlarged view magnifying the base plate 32 and the swirl plate 33 shown in FIG. 2.

In the burner 5 shown in FIG. 2, a plurality of fuel nozzles 30 are attached to the fuel header 40. The fuel nozzles 30 are arranged along multiple goncentric circles (circumferences) differing in the radius. In this example, the fuel nozzles 30 are arranged along eight circles (circumferences) differing in the radius. In the radial direction, eight annular fuel nozzle groups (rows) are arranged (see FIG. 4 which will be explained later). One air hole 31 is arranged at the fuel discharge end of each fuel nozzle 30 in the axial direction (downstream end in the fuel discharge direction). Thus, each air hole 31 is arranged in association with a corresponding fuel nozzle 30. With one fuel nozzle 30 and one air hole 31 arranged as in this example, the fuel (fuel jet) 34 discharged from the fuel nozzle 30 and the air (air jet) 35 flowing through the air hole 31 can be injected into the combustion chamber 50 as a coaxial jet as shown in the enlarged view in FIG. 2.

Each air hole 31 is formed through the two substantially disc-shaped plates constituting the air hole plates (the base plate 32 and the swirl plate 33) corresponding to the position of each fuel nozzle 30. In the illustrated example, the air hole 31 in the base plate 32 is formed in the shape of a right cylinder in which the two circular end faces are orthogonal to the generating line, while the air hole 31 in the swirl plate 33 is formed in the shape of an oblique cylinder in which the two circular end faces are not orthogonal to the generating line.

The base plate 32 and the swirl plate 33 are attached to the fuel header 40 via a support 15. The support 15 shown in FIG. 2 is in a shape formed by bending a flat plate. By forming the support 15 like this example, structural reliability can be increased since thermal expansion in the circumferential direction can be absorbed by the bent structure.

The right cylindrical air hole 31 in the base plate 32 is arranged coaxially with the corresponding fuel nozzle 30. The oblique cylindrical air hole 31 in the swirl plate 33 is a swirl air hole having a swirl angle. One end of the air hole 31 in the swirl plate 33 is connected to one end of the air hole 31 in the base plate 32 on the combustion chamber 50's side. The other end of the air hole 31 in the swirl plate 33 (end on the combustion chamber 50's side) is shifted from the position of the former end of the air hole 31 in the swirl plate 33 in the tangential direction of the circle (circumference) on which a plurality of air holes 31 are arranged.

As shown in FIG. 3, the central axis of the air hole 31 in the swirl plate 33 (obtained by connecting the centers of the two circles formed at both ends of the air hole 31 in the swirl plate 33) extends obliquely to the swirl plate 33 to have a predetermined angle $\alpha°$ from the central axis of the fuel nozzle 30, the central axis of the air hole 31 in the base plate 32, and the central axis of the combustor liner 10. Here, the expression "have a predetermined angle" means that the central axis of the air hole 31 in the swirl plate 33 is not in parallel with the other central axes (the central axis of the fuel nozzle 30, the central axis of the air hole 31 in the base plate 32, and the central axis of the combustor liner 10). The angle $\alpha°$ prescribes the air discharge direction from the air hole 31. By forming the air hole 31 in the swirl plate 33 in the shape of an oblique tube (oblique cylinder) having the angle $\alpha°$ as in this example, a swirl component is given to the fluid flowing through the air hole 31 in the swirl plate 33 and the flame is stabilized by a circulating flow caused by the swirl component. The angle $\alpha°$ of each air hole 31 has been set at an optimum value in each row.

Incidentally, while the fuel nozzle 30 and the air hole 31 in the base plate 32 are arranged coaxially in this example, the central axis of the fuel nozzle 30 and the central axis of the air hole 31 in the base plate 32 do not need to perfectly coincide with each other. The two central axes may slightly deviate from each other as long as an air-fuel jet (jet of fuel and air) can be formed.

Part of the high-pressure air 101 that has been supplied to the gas turbine combustor 2 via the annular channel formed between the combustor liner 10 and the flow sleeve 11 of the gas turbine combustor 2 by the above-described coaxial jet structure is first supplied to the air holes 31 in the base plate 32 in the form of the air jet 35 shown in FIG. 2, led downstream through the air holes 31 in the base plate 32, rotated by the air holes 31 in the swirl plate 33, and supplied to the combustion chamber 50.

Since the fuel and air have not been mixed together yet in the air holes 31 formed in the base plate 32, spontaneous ignition of the fuel never occurs. Therefore, the base plate 32 and the swirl plate 33 are prevented from being melted or damaged and a gas turbine combustor 2 with high reliability can be provided. Further, the formation of a lot of such small coaxial jets increases the interfacial area between the fuel and air and promotes the mixing of the fuel and air, by which the amount of NOx generated by the combustion in the gas turbine combustor 2 can be reduced.

Figure 4:
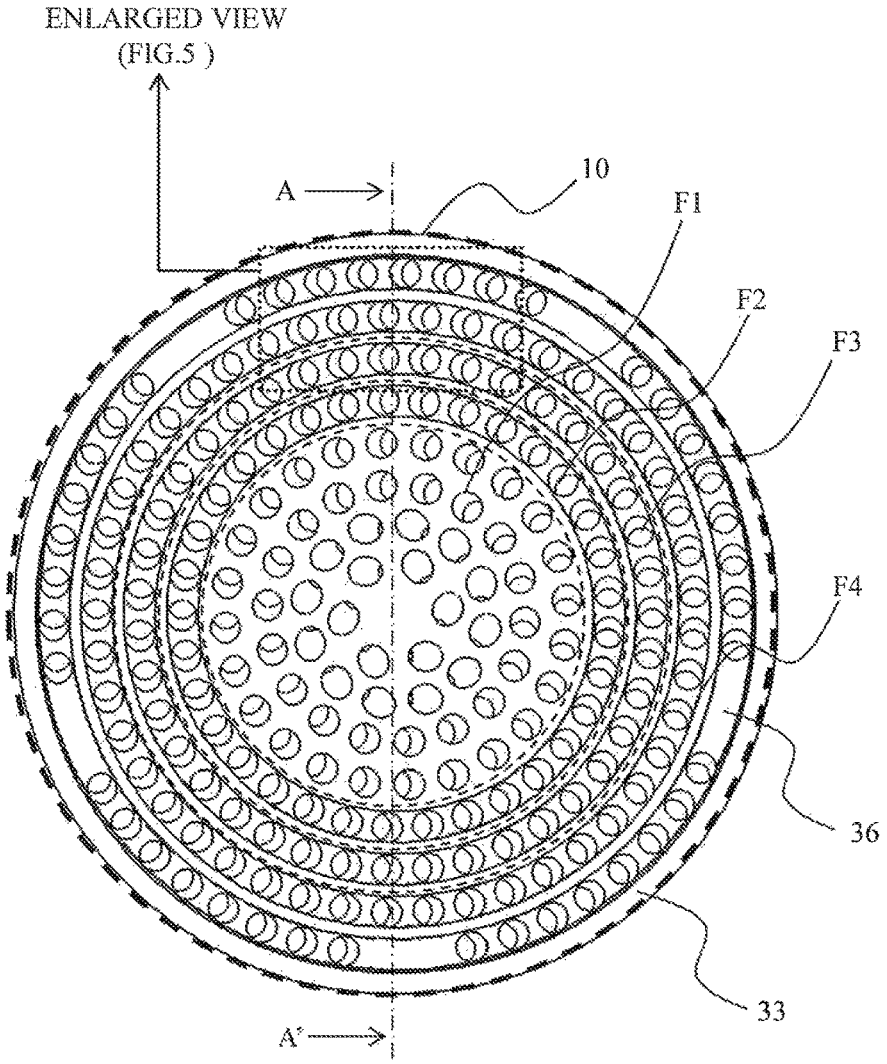
FIG. 4 is a schematic diagram of the air hole plates in the first embodiment of the present invention viewed from the downstream side.

FIG. 4 is a schematic diagram of the air hole plates (the base plate 32 and the swirl plate 33) in this embodiment viewed from the downstream side. In the gas turbine combustor 2 in this embodiment, the great number of air holes 31 (and the fuel nozzles 30 (unshown) paired with the air holes 31) are formed as eight annular air hole rows concentrically arranged in the radial direction of (from the center toward the periphery of) the disc-shaped air hole plates. In the following explanation, each air hole row included in the eight air hole rows can be referred to as the first row, the second row, . . . , and the eighth row from the center toward the periphery in order to discriminate between the air hole rows.

In this embodiment, the burner constituting a combustion unit of the gas turbine combustor 2 is divided into four groups. Four rows on the central side (first through fourth rows) constitute a first-group combustion unit (F1 burner), the fifth row constitutes a second-group combustion unit (F2 burner), the sixth row constitutes a third-group combustion unit (F3 burner), and two rows on the peripheral side (seventh and eighth rows) constitute a fourth-group combustion unit (F4 burner).

As shown in FIG. 1, the F1 burner is supplied with the fuel from the F1 fuel system 201 having the F1 fuel flow control valve 211, the F2 burner is supplied with the fuel from the F2 fuel system 202 having the F2 fuel flow control valve 212, the F3 burner is supplied with the fuel from the F3 fuel system 203 having the F3 fuel flow control valve 213, and the F4 burner is supplied with the fuel from the F4 fuel system 204 having the F4 fuel flow control valve 214.

Such group structure of the fuel systems 201-204 makes it possible to carry out the aforementioned fuel staging (changing the number of fuel nozzles 30 used for the fuel supply in stages in response to the change in the fuel flow rate of the gas turbine), secure high combustion stability and achieve the NOx reduction in the partial load operation of the gas turbine.

In the F1 burner, the distance of the gap formed by two adjacent air holes 31 (inter-hole distance) has been set at a value greater than the flame quenching distance. With this setting, the stability of the flame is enhanced by having the flame adhere to the gaps.

In contrast, in the F2 burner, the F3 burner and the F4 burner, in order to achieve low NOx combustion from the partial load condition to the full load condition, it is important to prevent the flame from adhering to the gap formed by two adjacent air holes 31 and to make the flame float at a position downstream of the swirl plate 33. The mixing of fuel and air in the coaxial jet of the fuel jet 34 and the air jet 35 progresses rapidly when the channel suddenly enlarges from the air holes 31 to the combustion chamber 50. Thus, if the flame is formed at a position apart downstream from the swirl plate 33, low NOx combustion can be performed since the combustion occurs in premixed gas of fuel and air sufficiently mixed together.

Therefore, in this embodiment, grooves 36 connected with the air holes 31 are formed on the surface of the swirl plate 33 on the combustion chamber 50's side for the air holes of the fifth through eight rows constituting the F2 burner, the F3 burner and the F4 burner. In the following explanation, a region on the swirl plate 33 where no grooves 36 are formed for the F1 burner can be referred to as a "first region", and a region on the swirl plate 33 with the grooves 36 of the F2 burner, the F3 burner and the F4 burner can be referred to as a "second region". In other words, the first region corresponds to a region on the swirl plate 33 where the radial distance from the center of the swirl plate 33 is less than a predetermined value, and the second region corresponds to a region on the swirl plate 33 where the radial distance from the center is the predetermined value or more.

The grooves 36 are formed to be situated on the downstream side in regard to the air discharge direction from the air holes 31 in the swirl plate 33. The grooves 36 in this embodiment are formed annularly on the swirl plate 33 to coincide with the direction of arrangement of the circumferentially arranged air hole rows. On the swirl plate 33, four concentric circular grooves 36 differing in the radius are formed. Incidentally, the air discharge direction from the air hole 31 in the swirl plate 33 corresponds to the direction of the central axis of the air hole 31 in the swirl plate 33 (at the angle $\alpha°$ from the central axis of the fuel nozzle 30). The arrangement of each groove 36 with respect to the air holes 31 may be set with reference to the direction of each straight line obtained as the orthographic projection of the central axis of each air hole 31 in the swirl plate 33 onto the swirl plate 33 (in this embodiment, the tangential direction of the circle of each air hole row). For the above reason, the annular grooves 36 in this embodiment are arranged to coincide with the direction of arrangement of the air holes 31.

Figure 5:
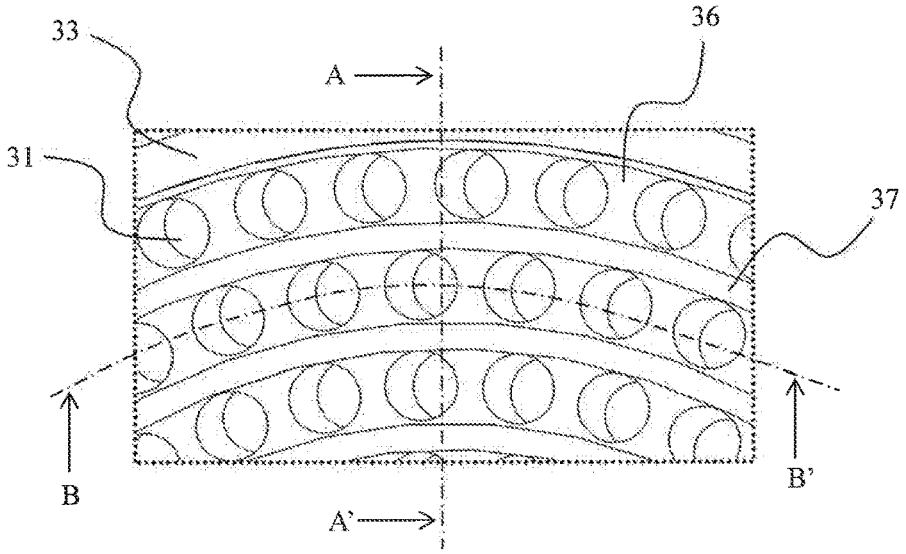
FIG. 5 is an enlarged view of the region in FIG. 4 surrounded by the dotted-line rectangle.
Figure 6:
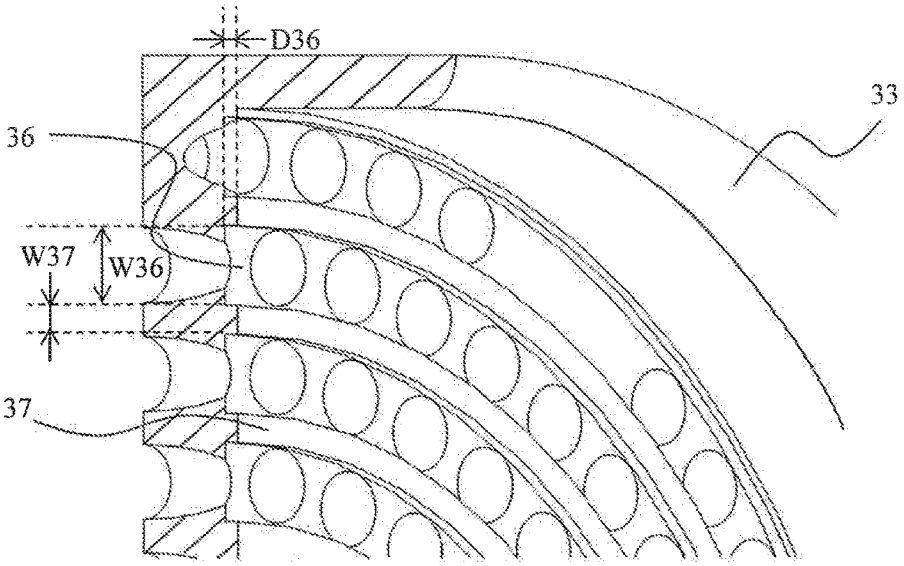
FIG. 6 is a perspective view of the A-A' cross section in FIG. 5.

FIG. 5 is an enlarged view of the region in FIG. 4 surrounded by the dotted-line rectangle. FIG. 6 is a perspective view of the A-A' cross section in FIG. 5. As shown in FIGS. 5 and 6, the width W36 of the groove 36 (size of the groove 36 in the radial direction of the plates 32 and 33) is equivalent to the hole diameter of the air hole 31. The width W37 of the gap (hereinafter referred to also as a "remaining part" as needed) 37 formed by two grooves 36 adjacent to each other in the radial direction of the plates 32 and 33 (size of the remaining part 37 in the radial direction of the plates 32 and 33) has been set at a value (e.g., several millimeters) not greater than the flame quenching distance. The depth D36 of the groove 36 with reference to the remaining part 37 (size of the groove 36 in the axial direction of the plates 32 and 33) is equivalent to the width of the remaining part 37 (e.g., several millimeters).

Figure 7:
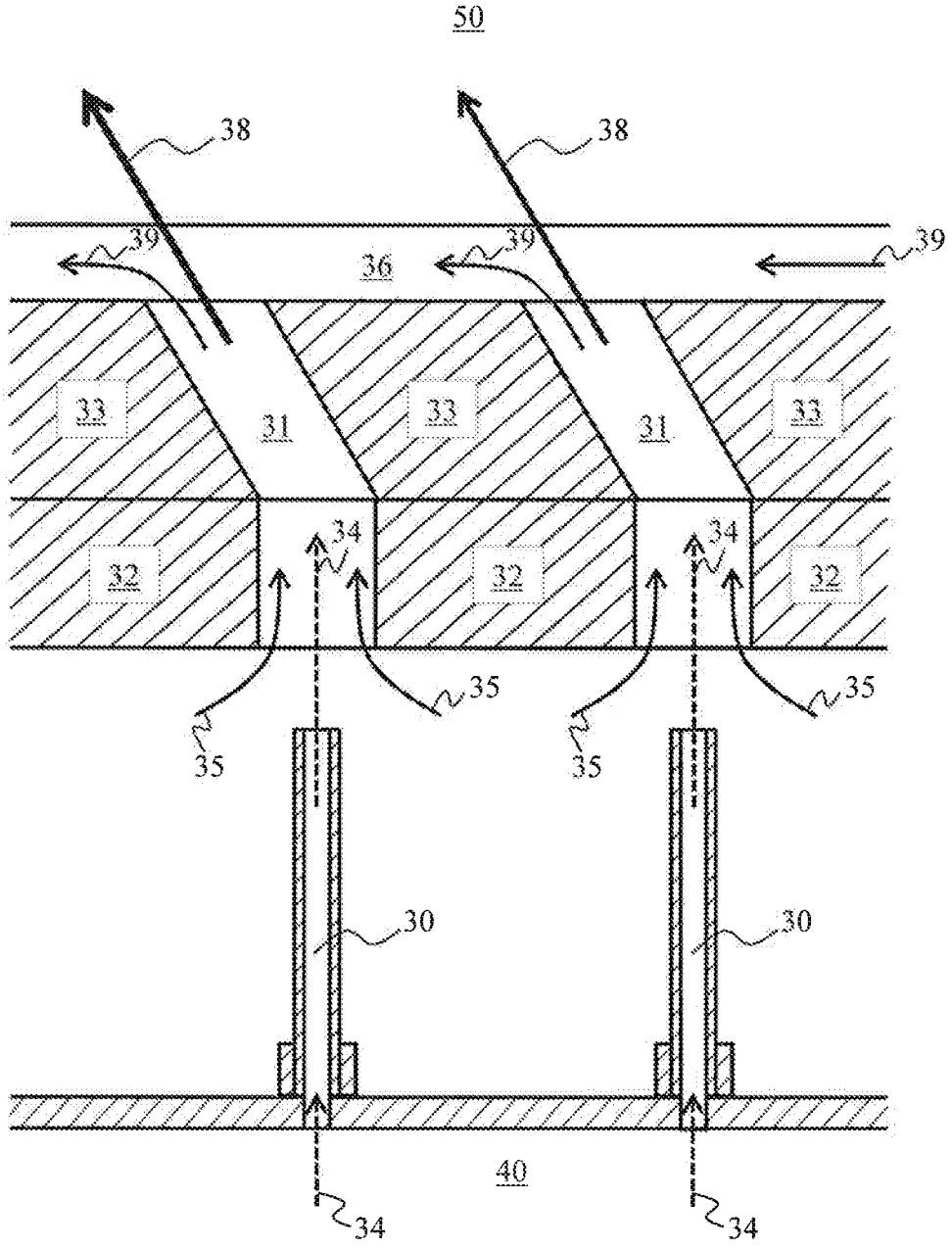
FIG. 7 is a cross-sectional view schematically showing the flow of fuel and air in regard to the B-B' cross section in FIG. 5.

The flow of fuel and air in this embodiment will be explained below by referring to FIG. 7. FIG. 7 is a cross-sectional view schematically showing the flow of fuel and air in regard to the B-B' cross section in FIG. 5. As shown in FIG. 7, the fuel supplied from the fuel header 40 to each fuel nozzle 30 is discharged from the discharge hole of the fuel nozzle 30 and flows downstream into the corresponding air hole 31 as the fuel jet 34. The compressed air 101 supplied from the compressor 1 cools down the inner tail tube 12 and the combustor liner 10 by means of convection cooling and thereafter flows downstream into the air hole 31 as the air jet 35. The air hole 31 in the base plate 32 is a straight duct (right cylinder), whereas the downstream air hole 31 in the swirl plate 33 is an oblique duct (oblique cylinder). Since the mixing of the fuel jet 34 and the air jet 35 progresses inside the air hole 31, the fuel and the air are mixed together and form an unburned premixed gas in the vicinity of the outlet of the air hole 31 in the swirl plate 33. Since the mixing of fuel and air progresses rapidly when the channel suddenly enlarges from the air holes 31 to the combustion chamber 50 as mentioned above, the fuel and the air have not been perfectly mixed together in the strict sense in the vicinity of the outlet of the air hole 31. However, the air-fuel mixture in the vicinity of the outlet of the air hole 31 will be referred to as "unburned premixed gas" in this explanation for the sake of convenience.

The unburned premixed gas to which the rotation has been given by the air hole 31 in the swirl plate 33 flows into the combustion chamber 50 as an unburned premixed gas mainstream 38 and combusts in the combustion chamber 50. Since the rotation has been given to the unburned premixed gas, an unburned premixed gas substream 39 as a part of the unburned premixed gas flows downstream along a groove 36 due to the momentum of the swirl component. Since the unburned premixed gas substream 39 flowing into the groove 36 thereafter flows in the circumferential direction along the groove 36 formed circumferentially, adhesion of flame to the part between two air holes 31 included in the same air hole row and adjacent to each other in the circumferential direction is prevented.

The "flame quenching distance" means a limit dimension in which flame can exist stably. The flame quenching distance is generally 2-3 mm while the distance varies depending on environmental conditions such as temperature and pressure. Therefore, by setting the width of the remaining part 37 at several millimeters as mentioned above, the adhesion of flame to the remaining part 37 can be prevented with ease since the dimension of the remaining part 37 becomes equivalent to the ordinary flame quenching distance. Accordingly, the adhesion of flame to the swirl plate 33 is prevented in the F2-F4 burners having the grooves 36 and the remaining parts 37 arranged downstream of the air holes 31 in the swirl plate 33.

Consequently, in the F1 burner situated at the center of the burner 5, the flame adheres to the swirl plate 33 and high combustion stability is secured. Further, the F1 burner transmits combustion heat sufficient for the completion of the combustion to the F2 burner, the F3 burner and the F4 burner. In the F2-F4 burners situated in the peripheral part of the burner 5, low NOx combustion can be achieved since the adhesion of flame to the swirl plate 33 is prevented by the effect of the grooves 36.

Figure 8:
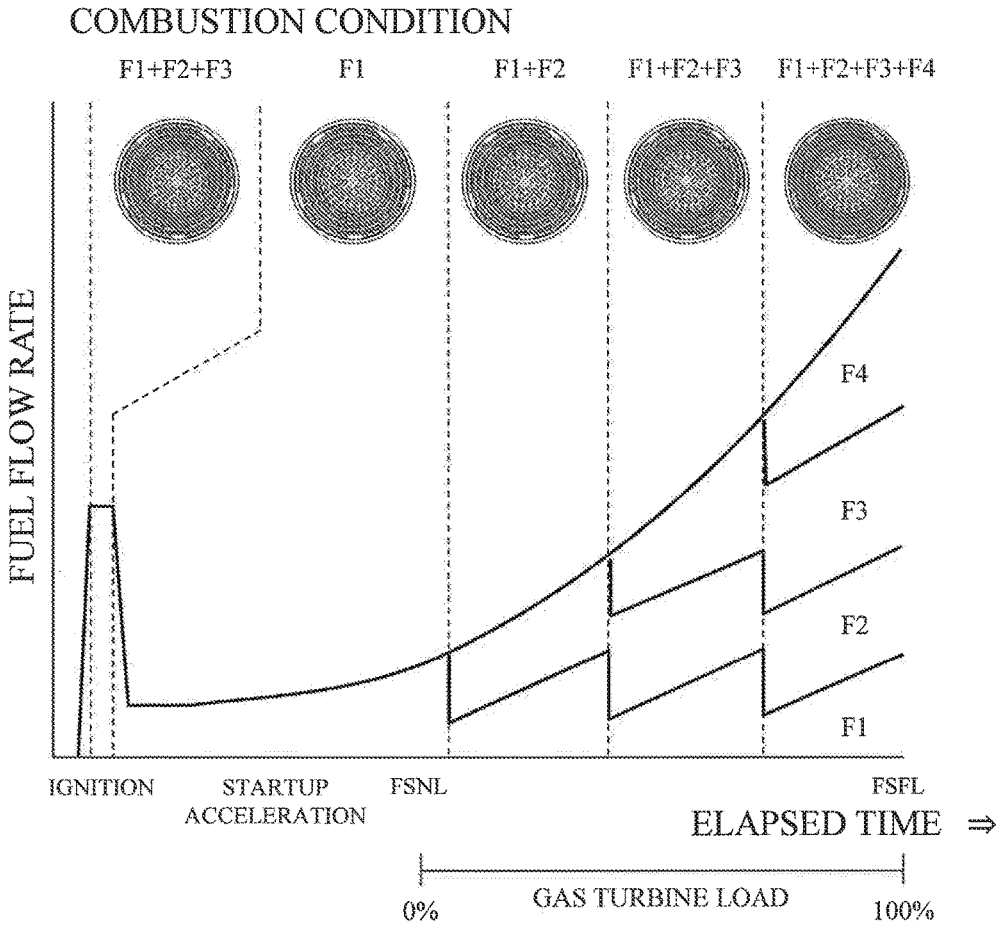
FIG. 8 shows a method of operating the combustor 2 of the gas turbine plant 1000 in accordance with the first embodiment of the present invention.

FIG. 8 shows the fuel staging in the radial direction as a method of operating the combustor 2 of the gas turbine plant 1000 according to this embodiment, wherein the horizontal axis represents the time and the vertical axis represents the fuel flow rate. First, at the ignition of the gas turbine, the F1-F3 burners (the first through sixth rows) are supplied with the fuel and brought into combustion as shown in FIG. 8, whereas the F4 burner (the seventh and eighth rows) is not supplied with the fuel.

After the ignition, the operation is switched to solo combustion of the F1 burner (the first through fourth rows) and the turbine 3 is accelerated until the turbine 3 reaches the rated revolution speed no load state (FSNL: Full Speed No Load). After accelerating the turbine 3 to the rated revolution speed, the power generation is started and the load is increased gradually. With the increase in the load, the fuel systems to which the fuel is supplied are increased successively in the order of the F1 burner, the F2 burner, the F3 burner and the F4 burner so that the fuel-air ratio of the burner 5 of the gas turbine combustor 2 remains in a stable combustion range. By this control, the rated revolution speed full load state (FSFL: Full Speed Full Load) can be achieved in the combustion condition in which all the burners (F1-F4 burners) are supplied with the fuel.

As described above, according to this embodiment, high combustion stability can be secured at the center of the burner since the flame adheres to the swirl plate 33 at the center of the burner and low NOx combustion can be achieved in the peripheral part of the burner since the flame does not adhere to the swirl plate 33 in the peripheral part of the burner. In short, both stable combustion and low NOx combustion can be achieved by this embodiment.

(2) Second Embodiment

Next, a gas turbine combustor in accordance with a second embodiment of the present invention will be described below. The basic configuration of the gas turbine and the gas turbine combustor according to this embodiment is equivalent to that in the first embodiment shown in FIGS. 1-8. Therefore, the following explanation will be given mainly of the difference from the first embodiment while omitting explanation of the configuration and effects common to the first and second embodiments. The method of operating the combustor 2 in this embodiment is substantially equivalent to that in the first embodiment explained referring to FIG. 8 and thus repeated explanation thereof is omitted for brevity.

Figure 9:
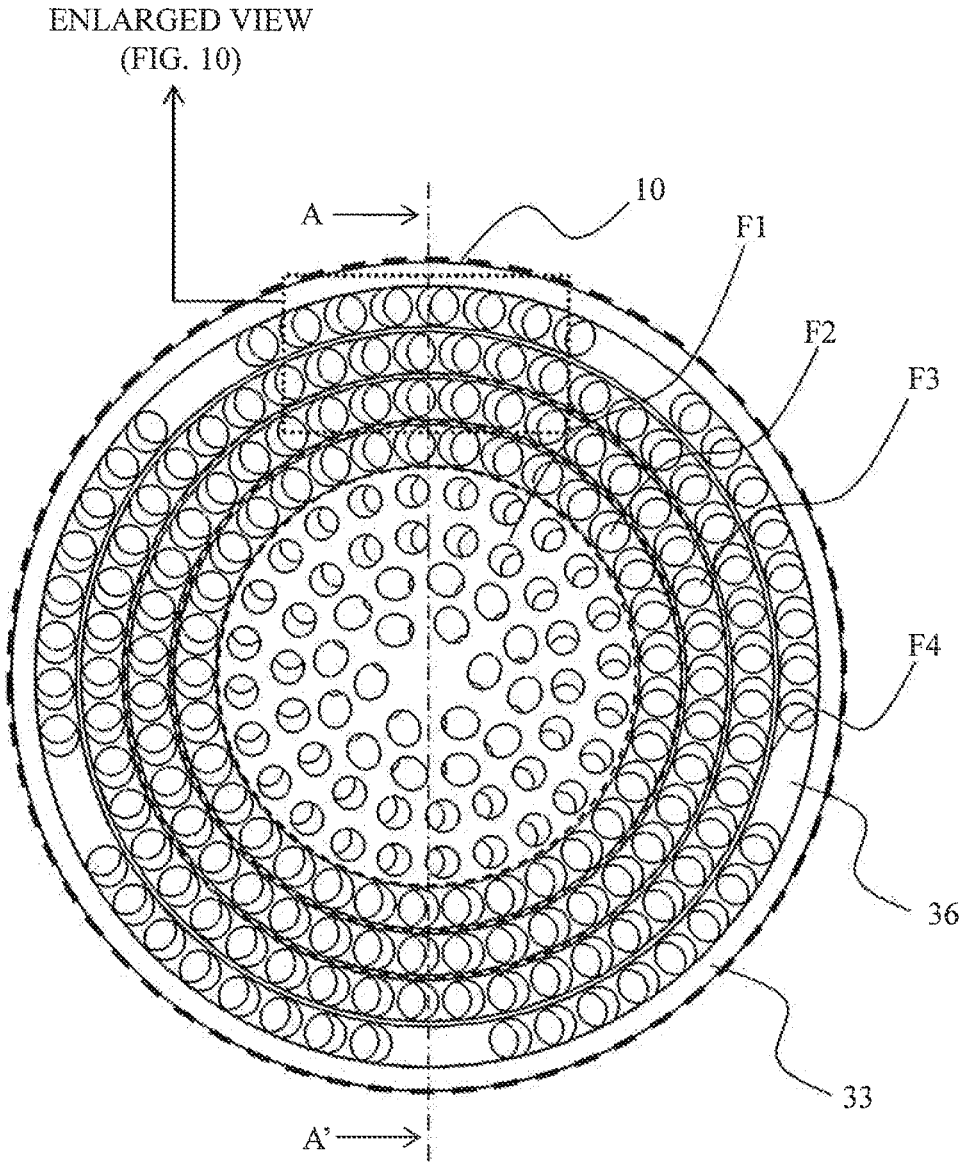
FIG. 9 is a schematic diagram of the air hole plates in the second embodiment of the present invention viewed from the downstream side.

FIG. 9 is a schematic diagram of the air hole plates (the base plate 32 and the swirl plate 33) in the second embodiment of the present invention viewed from the downstream side. This embodiment differs from the first embodiment in that the hole diameter of the air holes 31 in the swirl plate 33 in the F2, F3 and F4 burners (second region) provided with the grooves 36 is greater than the hole diameter of the air holes 31 in the F1 burner (first region) provided with no grooves 36. In the illustrated example, the hole diameter of the air holes 31 in the F2-F 4 burners (second region) is set at approximately 1.2 times the hole diameter in the F1 burner (first region). Setting the hole diameter in the F2-F4 burners (second region) greater than 1.2 times the hole diameter in the F1 burner (first region) has no problem since greater effect can be expected from a greater hole diameter as long as air holes 31 having the hole diameter are possible in the swirl plate 33 with no interference between adjacent air holes 31.

Figure 10:
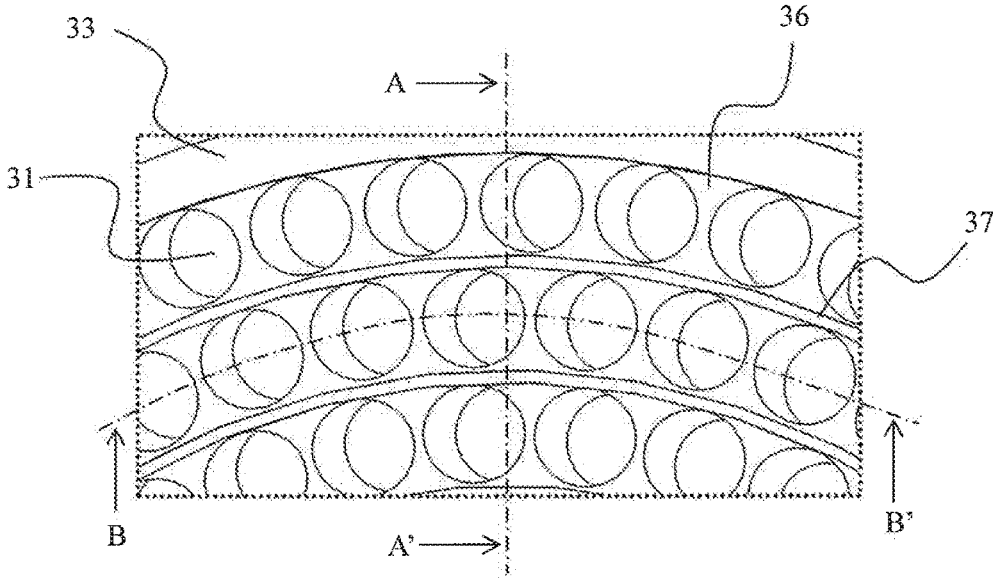
FIG. 10 is an enlarged view of the region in FIG. 9 surrounded by the dotted-line rectangle.
Figure 11:
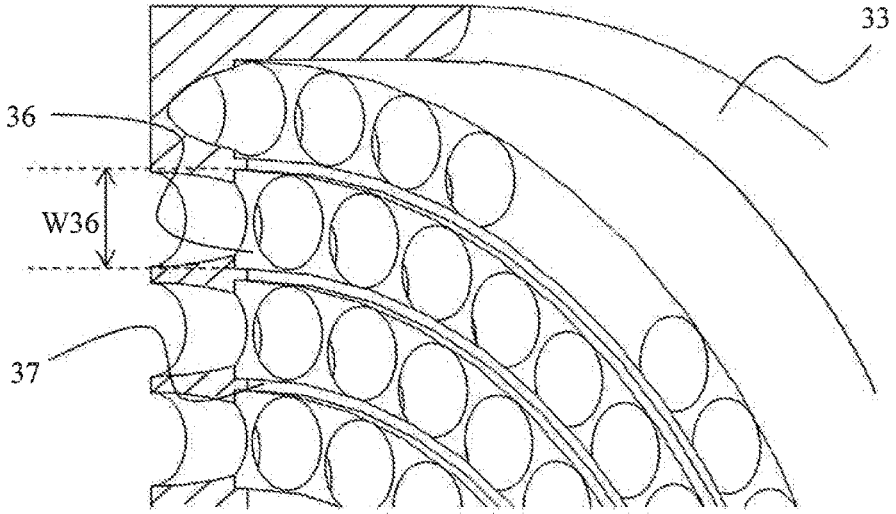
FIG. 11 is a perspective view of the A-A' cross section in FIG. 10.

FIG. 10 is an enlarged view of the region in FIG. 9 surrounded by the dotted-line rectangle. FIG. 11 is a perspective view of the A-A' cross section in FIG. 10. As is clear from FIGS. 10 and 11, the hole diameter of the air holes 31 in the swirl plate 33 is increased by reducing the width W37 of the remaining parts 37 while securing the width W36 of the grooves 36. The depth D36 of the groove 36 with reference to the remaining part 37 is set at several millimeters similarly to the first embodiment.

Figure 12:
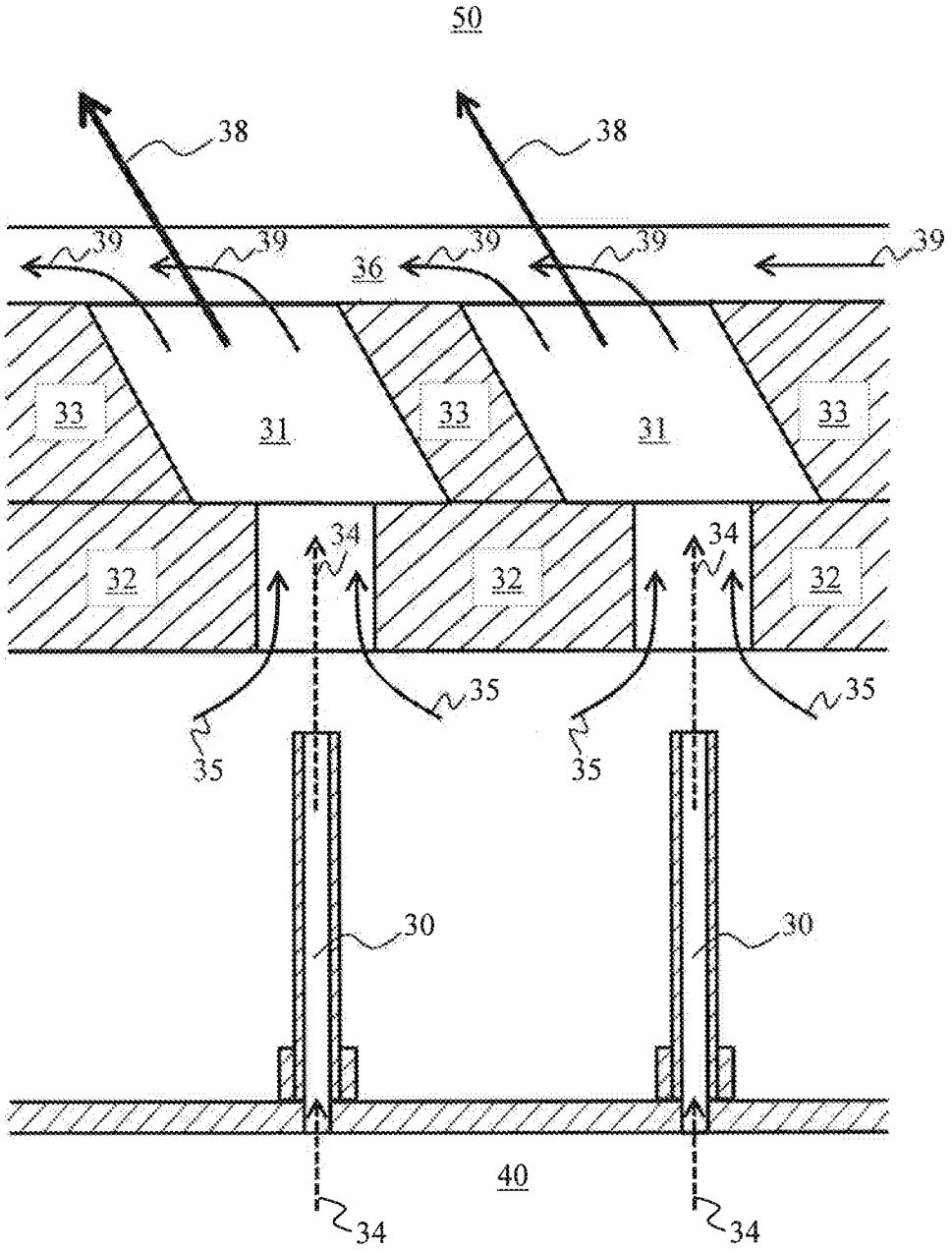
FIG. 12 is a cross-sectional view schematically showing the flow of fuel and air in regard to the B-B' cross section in FIG. 10.

The flow of fuel and air in this embodiment will be explained below by referring to FIG. 12. FIG. 12 is a cross-sectional view schematically showing the flow of fuel and air in regard to the B-B' cross section in FIG. 10. As is clear from comparison between FIG. 12 and FIG. 7, the air holes 31 in the swirl plate 33 in this embodiment are formed with a greater hole diameter compared to the first embodiment while the air holes 31 in the base plate 32 in this embodiment are in the same shape as in the first embodiment.

In the air hole 31 configured as above, the unburned premixed gas is formed by the mixing of the fuel jet 34 and the air jet 35, provided with the rotation in the swirl plate 33, and supplied to the combustion chamber 50 similarly to the first embodiment. In this embodiment, however, the increase in the hole diameter of the air holes 31 in the swirl plate 33 makes it possible to feed the unburned premixed gas substream 39 to wider grooves 36 compared to the first embodiment, and thus the adhesion of flame can be prevented in a large area on the swirl plate 33. Further, the increase in the width W36 of the grooves 36 naturally leads to a decrease in the width of the remaining parts 37 compared to the first embodiment. The width of the remaining parts 37 becomes equivalent to or less than the flame quenching distance and the adhesion of flame to the remaining parts 37 can be prevented more effectively compared to the first embodiment.

Therefore, even if the grooves 36 are formed as in this embodiment, high combustion stability can be secured at the center of the burner since the flame adheres to the swirl plate 33 at the center of the burner and low NOx combustion can be achieved in the peripheral part of the burner since the flame does not adhere to the swirl plate 33 in the peripheral part of the burner. Consequently, both stable combustion and low NOx combustion can be achieved.

Figure 13:
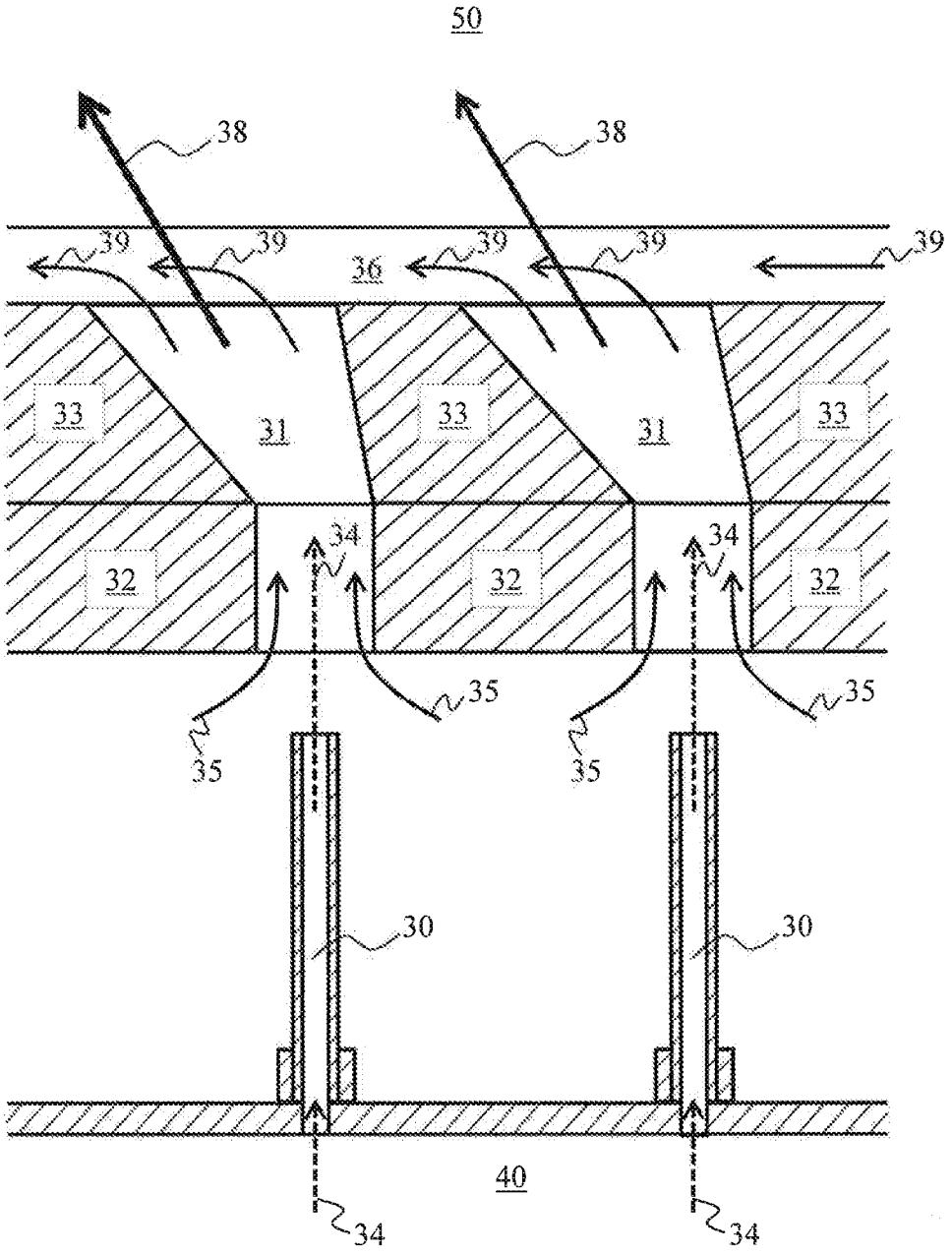
FIG. 13 is a cross-sectional view of a gas turbine combustor according to a modification of the second embodiment of the present invention.

FIG. 13 is a cross-sectional view of a gas turbine combustor according to a modification of the second embodiment of the present invention. This cross-sectional view illustrates the gas turbine combustor according to the modification at the same cross section as in FIG. 12 and schematically shows the flow of fuel and air at the cross section.

In the gas turbine combustor shown in FIG. 13, the air holes 31 in the swirl plate 33 are formed so that their hole diameter gradually increases toward the air hole outlet. With this configuration of the air hole 31, no step (like the one shown in FIG. 12) occurs in the connecting part between the air hole 31 formed in the base plate 32 and the air hole 31 formed in the swirl plate 33. Accordingly, flow instability in the air hole 31 due to vortices, etc. caused by the sudden enlargement of the channel can be avoided. Further, while the sudden enlargement of the channel causes an increase in the pressure loss, smoothly increasing the cross-sectional area of the channel as in this modification reduces the pressure loss caused by the passage of air through the air hole 31 and that contributes to an increase in the efficiency of the gas turbine.

Incidentally, while the hole diameter of the air holes 31 in the swirl plate 33 is set larger than that of the air holes 31 in the base plate 32 in this embodiment, the flame adhesion suppressing effect can be expected in the same way even if the hole diameter in the base plate 32 is set at a large value to be equal to the hole diameter in the swirl plate 33.

(3) Third Embodiment

Next, a gas turbine combustor in accordance with a third embodiment of the present invention will be described below. The basic configuration of the gas turbine and the gas turbine combustor according to this embodiment is also equivalent to that in the first embodiment shown in FIGS. 1-8, and thus the following explanation will be given mainly of the difference from the first embodiment. The method of operating the combustor of the gas turbine plant in this embodiment is also substantially equivalent to that in the first embodiment of the present invention and thus repeated explanation thereof is omitted for brevity.

Figure 14:
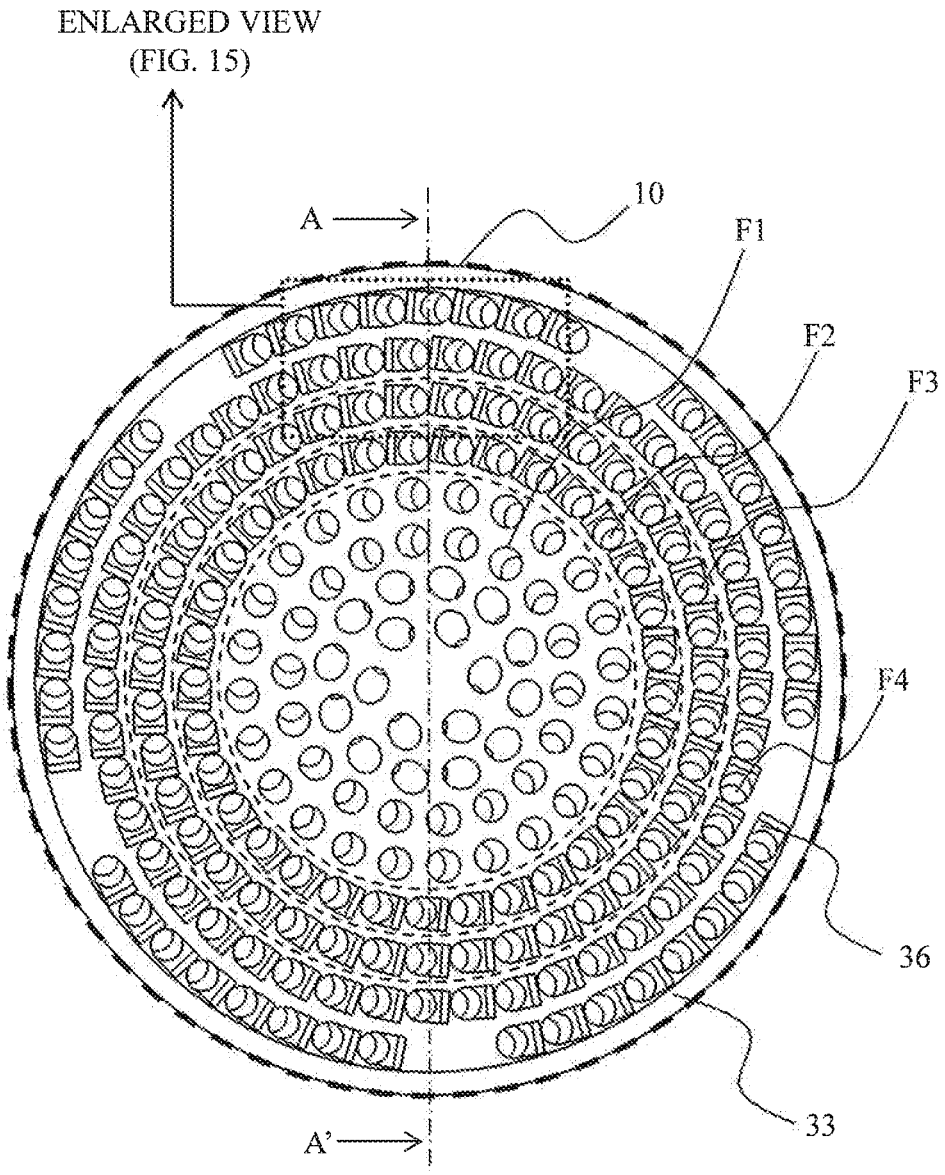
FIG. 14 is a schematic diagram of the air hole plates in the third embodiment of the present invention viewed from the downstream side.

FIG. 14 is a schematic diagram of the air hole plates (the base plate 32 and the swirl plate 33) in the third embodiment of the present invention viewed from the downstream side.

The grooves 36 formed in the F2, F3 and F4 burners in this embodiment differ from those in the prior two embodiments in that each groove 36 in this embodiment is formed as an independent groove for one air hole 31, not as the annular groove in the prior two embodiments having a plurality of circumferentially arranged air holes 31 at its bottom.

Each of the grooves 36 in this embodiment is formed to be connected with the outlet of one air hole 31 and to extend a predetermined distance on the swirl plate 33 from the connecting part in the air discharge direction of the air hole 31. Needless to say, the distance of extension of each groove 36 is less than the distance from the air hole 31 to another air hole 31 situated downstream in regard to the air circulation in the circumferential direction.

Figure 15:
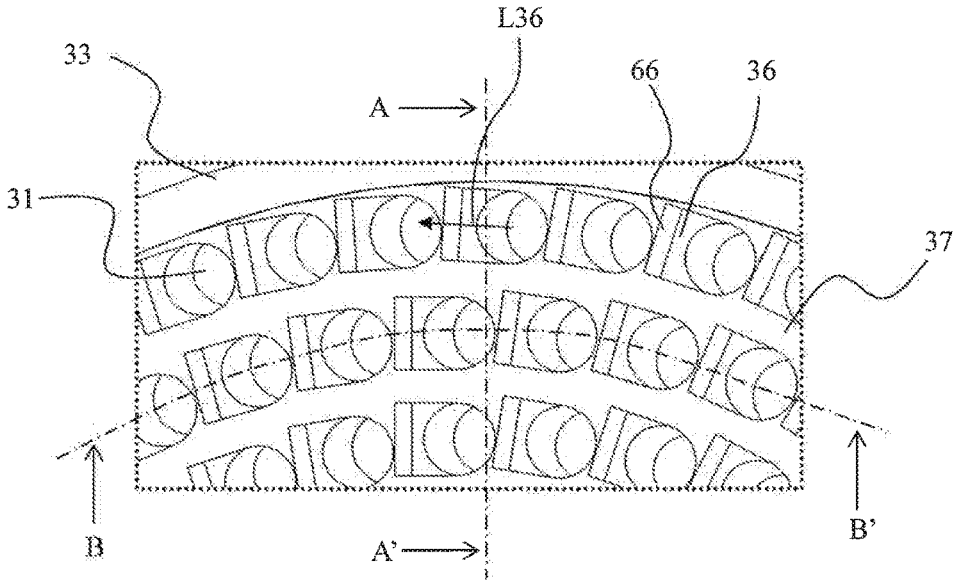
FIG. 15 is an enlarged view of the region in FIG. 14 surrounded by the dotted-line rectangle.
Figure 16:
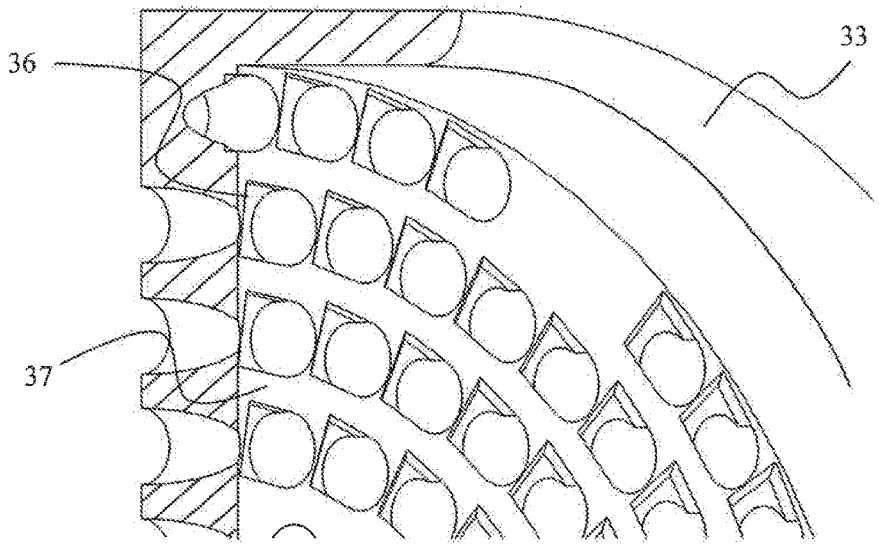
FIG. 16 is a perspective view of the A-A' cross section in FIG. 15.

FIG. 15 is an enlarged view of the region in FIG. 14 surrounded by the dotted-line rectangle. FIG. 16 is a perspective view of the A-A' cross section in FIG. 15. As shown in FIGS. 15 and 16, the direction in which each groove 36 in this embodiment extends on the swirl plate 33 corresponds to the direction of the straight line obtained as the orthographic projection of the central axis (prescribing the air discharge direction from the air hole 31) onto the swirl plate 33 (e.g., the arrow L36 in FIG. 15). In the illustrated example, the direction coincides with the tangential direction of the circumference formed by the air hole row to which each air hole 31 belongs. Thus, each groove 36 in this embodiment extends in the tangential direction of the circumference (formed by the air hole line to which each air hole 31 belongs) at the position of the air hole 31. On the downstream side of each groove 36 in regard to the air discharge direction, a tilt part 66 is formed, in which the depth of the groove 36 gradually decreases as it goes downstream in the air discharge direction.

Figure 17:
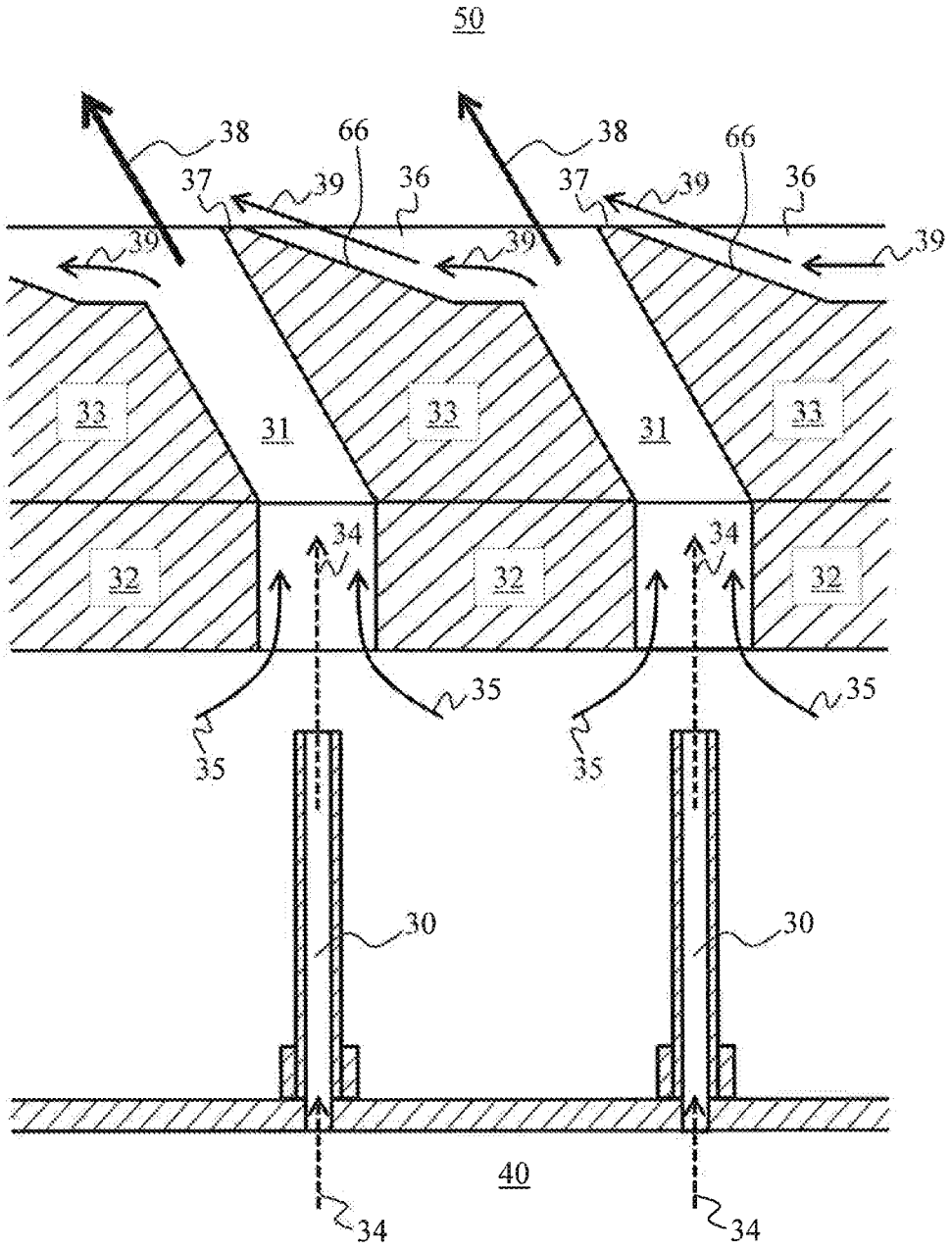
FIG. 17 is a cross-sectional view schematically showing the flow of fuel and air in regard to the B-B' cross section in FIG. 15.

The flow of fuel and air in this embodiment will be explained below by referring to FIG. 17. FIG. 17 is a cross-sectional view schematically showing the flow of fuel and air in regard to the B-B' cross section in FIG. 15. As shown in FIG. 17, in each air hole 31 in this embodiment, the unburned premixed gas is formed by the mixing of the fuel jet 34 and the air jet 35, provided with the rotation in the swirl plate 33, and supplied to the combustion chamber 50 similarly to the first and second embodiments. At this point, the unburned premixed gas separates into an unburned premixed gas mainstream 38 discharged in the direction of the central axis of the air hole 31 and an unburned premixed gas substream 39 flowing along the surface of the groove 36.

The unburned premixed gas mainstream 38 is directly supplied to the combustion chamber 50. On the other hand, the unburned premixed gas substream 39 is supplied to the combustion chamber 50 after flowing along the groove 36 connecting with the outlet of the air hole 31. Since the extending direction of the groove 36 coincides with the direction of the rotation of the air hole 31 (direction of the central axis) when viewed in the axial direction of the combustor liner 10, the momentum of the unburned premixed gas substream 39 can be utilized more efficiently and the unburned premixed gas substream 39 can be fed to the entire region of the groove 36 with greater ease in comparison with the first and second embodiments in which the grooves 36 are formed in the circumferential direction (annularly). Accordingly, the adhesion of flame to the swirl plate 33 can be prevented effectively. Further, since each groove 36 is independent, interference with the unburned premixed gas substream 39 supplied from adjacent air holes 31 can be prevented in each groove 36.

Therefore, also by this embodiment, both stable combustion and low NOx combustion can be achieved by securing high combustion stability at the center of the burner 5 (by having the flame adhere to the swirl plate) and achieving low NOx combustion in the peripheral part of the burner 5 (by preventing the flame from adhering to the swirl plate).

Figure 18:
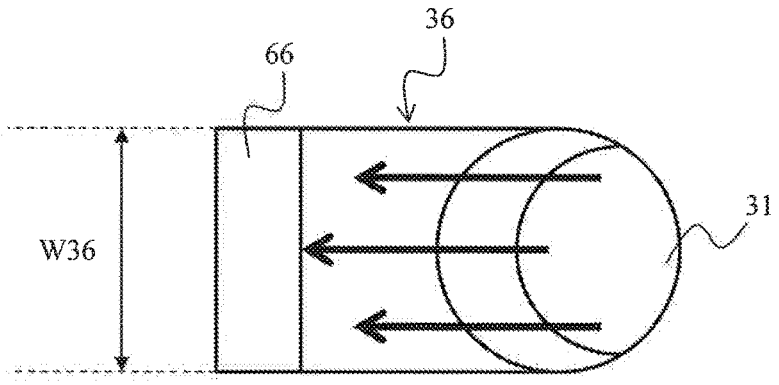
FIG. 18 is an enlarged view of a groove 36 in the third embodiment of the present invention.
Figure 19:
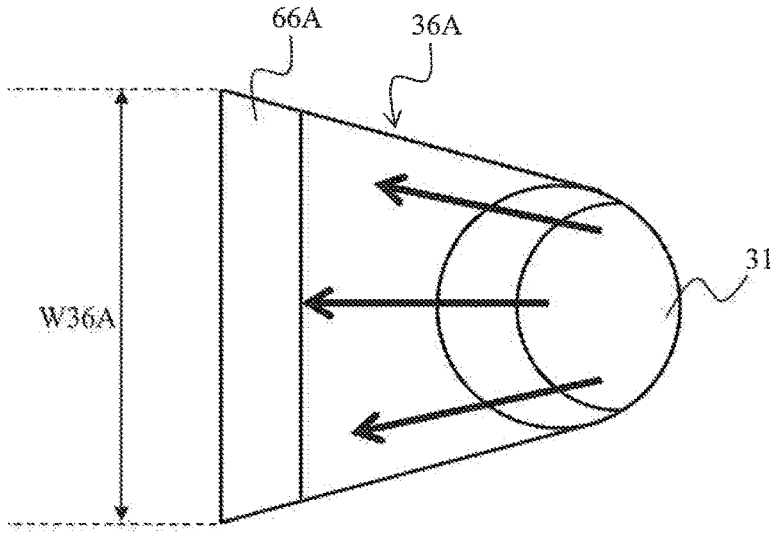
FIG. 19 is an enlarged view of a modification of the groove 36 in the third embodiment of the present invention.

FIG. 18 is an enlarged view of the groove 36 in this embodiment. FIG. 19 is an enlarged view of a modification of the groove 36 in this embodiment. While the width W36 of the groove 36 in this embodiment is kept constant at a dimension equivalent to the hole diameter of the air hole 31 as shown in FIG. 18, the groove 36 may also be configured as shown in FIG. 19. In FIG. 19, the width W36A of the groove 36A is gradually increased as it goes downstream in the air discharge direction regarding the groove 36A and the unburned premixed gas substream 39 is fed to the combustion chamber 50 while gradually increasing the width of the substream 39. With the groove 36A configured as shown in FIG. 19, the unburned premixed gas substream 39 can be fed to a larger area compared to the case where the groove width is constant, by which the adhesion of flame to the swirl plate 33 can be suppressed with ease in a large area. Further, since the remaining parts 37 of the swirl plate 33 become smaller, the adhesion of flame to the remaining parts 37 can also be prevented.

While the above embodiments have been explained by taking examples of combustors configured by concentrically arranging multiple rows (eight rows) of fuel nozzles and air holes around the center of the swirl plate 33 (air hole plate), the present invention is applicable also to combustors (multi-injection type combustors) configured by concentrically arranging fuel nozzles and air holes around multiple points on the swirl plate 33. An example of such a configuration will be explained below by referring to FIGS. 20-23 as a fourth embodiment of the present invention.

(4) Fourth Embodiment

The basic configuration of the gas turbine and the gas turbine combustor according to this embodiment is also equivalent to that in the first embodiment, and thus the following explanation will be given mainly of the difference from the first embodiment.

Figure 20:
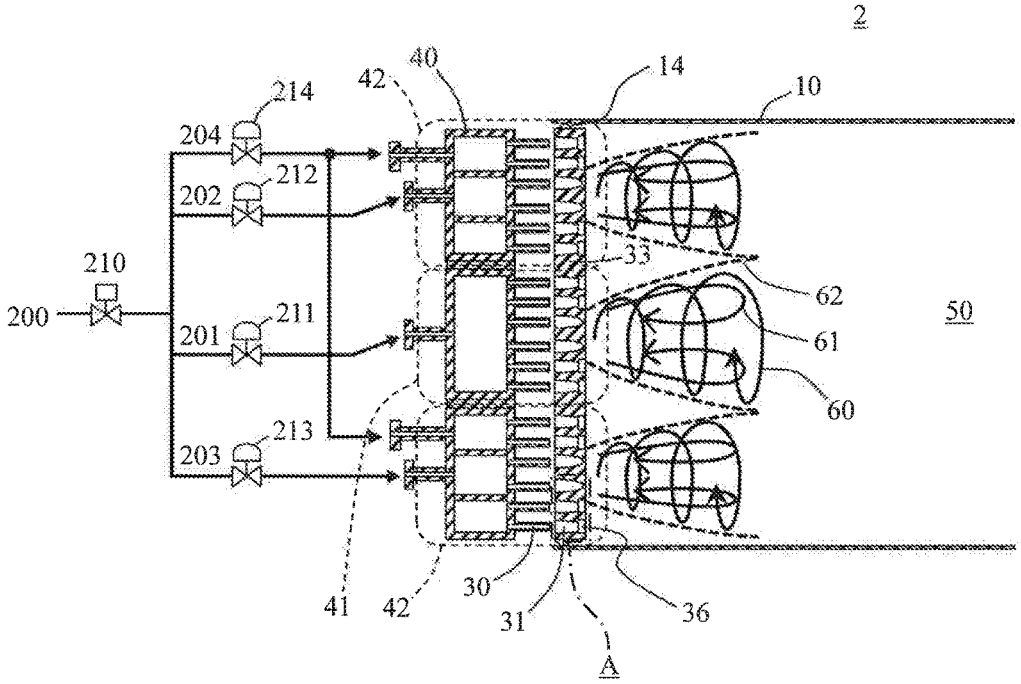
FIG. 20 is a cross-sectional view of a gas turbine combustor in accordance with a fourth embodiment of the present invention.
Figure 21:
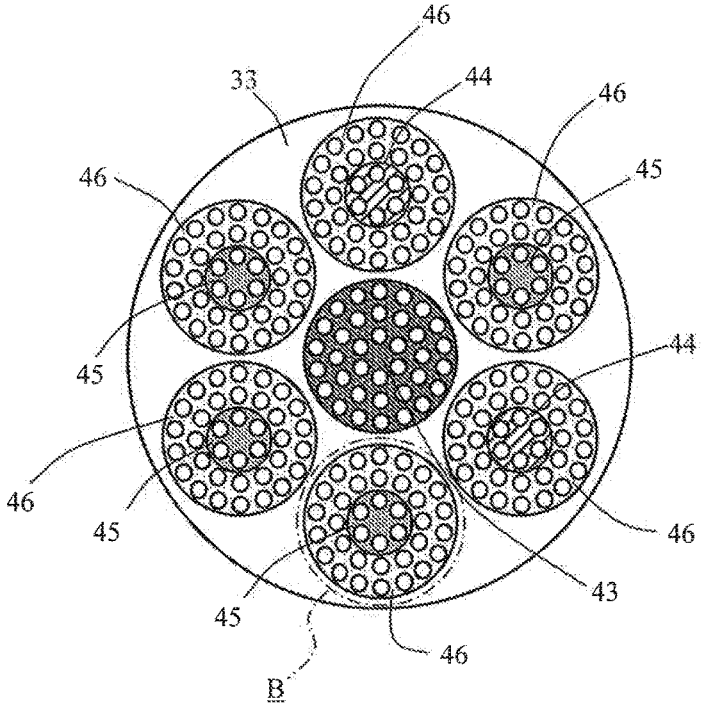
FIG. 21 is a schematic diagram of an air hole plate in the fourth embodiment of the present invention viewed from the downstream side.

FIG. 20 is a cross-sectional view of a gas turbine combustor in accordance with the fourth embodiment of the present invention (diagram corresponding to FIG. 2 regarding the first embodiment). FIG. 21 is a schematic diagram of an air hole plate in the fourth embodiment of the present invention viewed from the downstream side (diagram corresponding to FIG. 4 regarding the first embodiment).

The gas turbine combustor shown in FIGS. 20 and 21 comprises multiple burners (burner sets) 41/42 each being configured by concentrically arranging multiple rows (three rows) of fuel nozzles 30 and air holes 31. Specifically, a burner (burner set) is configured by arranging six fuel nozzles 30 and air holes 31 in the first row, twelve fuel nozzles 30 and air holes 31 in the second row, and eighteen fuel nozzles 30 and air holes 31 in the third row. A multi-burner structure including seven burners (burner sets) in total is formed by arranging one burner (burner set) at the axial center of the gas turbine combustor 2 as a pilot burner 41 and arranging six burners (burner sets) around the pilot burner 41 as main burners 42.

The burners in this embodiment are supplied with the fuel through a fuel system 200 having a fuel shut-off valve 210. Four fuel systems branch out from the fuel system 200: an F1 fuel system 201 having an F1 fuel flow control valve 211; an F2 fuel system 202 having an F2 fuel flow control valve 212; an F3 fuel system 203 having an F3 fuel flow control valve 213; and an F4 fuel system 204 having an F4 fuel flow control valve 214.

The flow rate of F1 fuel supplied through the F1 fuel system 201 is regulated by the F1 fuel flow control valve 211. The F1 fuel is supplied to an F1 burner 43 which is made up of the pilot burner 41. The flow rate of F2 fuel supplied through the F2 fuel system 202 is regulated by the F2 fuel flow control valve 212. The F2 fuel is supplied to an F2 burner 44 which is made up of the first rows of two burner sets in the main burners 42. The flow rate of F3 fuel supplied to the burner 5 through the F3 fuel system 203 is regulated by the F3 fuel flow control valve 213. The F3 fuel is supplied to an F3 burner 45 which is made up of the first rows of four burner sets in the main burners 42. The flow rate of F4 fuel supplied to the burner 5 through the F4 fuel system 204 is regulated by the F4 fuel flow control valve 214. The F4 fuel is supplied to an F4 burner 46 which is made up of the second and third rows of all the burner sets in the main burners 42.

Similarly to the first embodiment, the structure supplying the fuel from four fuel systems 201-204 makes it possible to carry out the fuel staging (changing the number of fuel nozzles used for the fuel supply in stages in response to the change in the fuel flow rate of the gas turbine), secure high combustion stability in the partial load operation of the gas turbine, and achieve the NOx reduction.

Further, in the swirl plate 33, a swirl component is given to the air holes 31 in the first, second and third rows of each burner. Accordingly, a swirl flow 60 is formed by each burner as shown in FIG. 20. Due to the swirl flow 60, a circulating flow 61 is formed at each burner, flame surfaces 62 are formed, and stable combustion is achieved.

Figure 22:
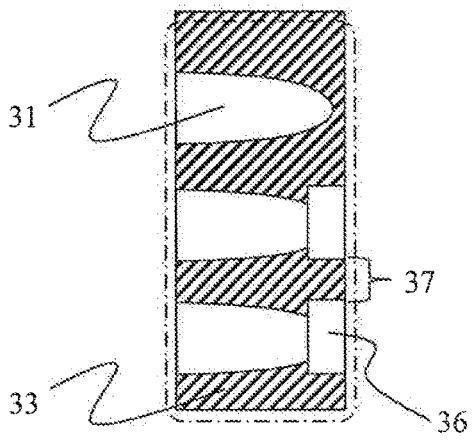
FIG. 22 is an enlarged view of a part of the swirl plate 33 surrounded by the chain-line rectangle (part A) in FIG. 20.
Figure 23:
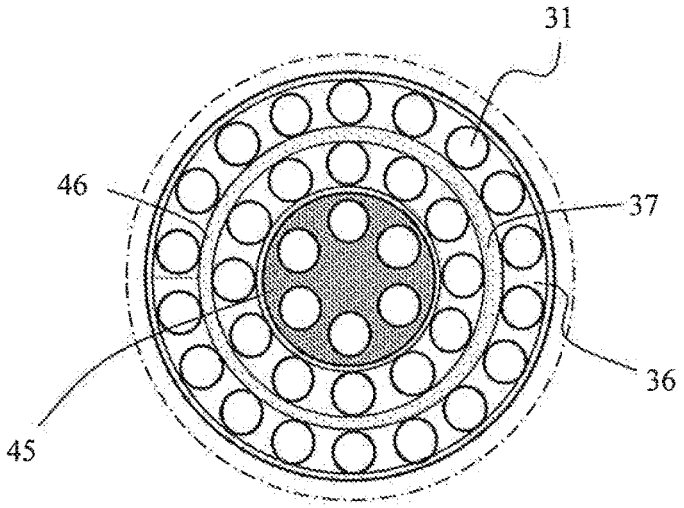
FIG. 23 is an enlarged view of one burner set in main burners 42 surrounded by the chain-line circle (part B) in FIG. 21.

FIG. 22 is an enlarged view of a part of the swirl plate 33 surrounded by the chain-line rectangle (part A) in FIG. 20. FIG. 23 is an enlarged view of one burner set in the main burners 42 surrounded by the chain-line circle (part B) in FIG. 21. In this multi-burner structure, high combustion stability is secured in the first row of each burner by having the flame adhere to the swirl plate 33 and low NOx combustion is achieved in the second and third rows of each burner by preventing the flame from adhering to the swirl plate 33. In this embodiment, the second and third rows of each burner have the grooves 36. Incidentally, each air hole 31 in this embodiment is configured as a swirl air hole having a swirl angle as shown in FIG. 22 similarly to the air holes 31 in the prior embodiments.

With the grooves 36 formed as in this embodiment, part of the unburned premixed gas of fuel and air supplied from the air holes 31 (unburned premixed gas substream) flows into the grooves 36, by which the adhesion of flame to the inter-hole gaps (parts between air holes) in the second row and the inter-hole gaps in the third row can be prevented. Further, the adhesion of flame to the remaining parts 37 can be prevented by setting the width of the groove 36 greater than or equal to the diameter of the air hole 31 and setting the width of the remaining part 37 less than or equal to the flame quenching distance. With this configuration, both stable combustion and low NOx combustion can be achieved by each burner in the multi-burner structure. Thus, according to this embodiment, both stable combustion and low NOx combustion can be achieved by securing high combustion stability in the first row of each burner (by having the flame adhere to the swirl plate) and achieving low NOx combustion in the second and third rows of each burner (by preventing the flame from adhering to the swirl plate).

While the second and third rows of every burner (pilot burner 41, main burner 42) are provided with the grooves 36 in this embodiment, the grooves 36 in the second and third rows of the pilot burner 41 can be left out. The combustion stability can be enhanced further by leaving out the grooves 36 in the second and third rows of the pilot burner 41.

It is to be noted that the present invention is not limited to the aforementioned embodiments, but covers various modifications. While, for illustrative purposes, those embodiments have been described specifically, the present invention is not necessarily limited to the specific forms disclosed. Thus, partial replacement is possible between the components of a certain embodiment and the components of another. Likewise, certain components can be added to or removed from the embodiments disclosed.

DESCRIPTION OF REFERENCE CHARACTERS

1: compressor, 2: gas turbine combustor, 3: turbine, 4: casing, 5: burner, 10: combustor liner, 11: flow sleeve, 12: inner tail tube, 13: outer tail tube, 14: spring seal, 15: support, 20: generator, 21: shaft, 30: fuel nozzle, 31: air hole, 32: base plate, 33: swirl plate, 34: fuel jet, 35: air jet, 36: groove, 37: remaining part, 38: unburned premixed gas mainstream, 39: unburned premixed gas substream, 40: fuel header, 50: combustion chamber, 100: intake air, 101: high-pressure air, 102: high-temperature combustion gas, 103: exhaust gas, 200: fuel system, 201: F1 fuel system, 202: F2 fuel system, 203: F3 fuel system, 204: F4 fuel system, 210: fuel shut-off valve, 211: F1 fuel flow control valve, 212: F2 fuel flow control valve, 213: F3 fuel flow control valve, 214: F4 fuel flow control valve, 1000: gas turbine plant

The invention claimed is:

1. A gas turbine combustor comprising:

a combustion chamber in which fuel is burned with air to generate combustion gas;

a fuel header having a plurality of fuel nozzles for discharging fuel;

an air hole plate provided with a plurality of air holes in rows formed by arranging the plurality of air holes in a circumferential direction of the air hole plate through which fuel discharged from the plurality of fuel nozzles and air are injected into the combustion chamber; and a plurality of grooves formed on a surface of the air hole plate on a side of the combustion chamber, the plurality of grooves being connected with the plurality of air holes; wherein each of the plurality of grooves is provided at least for each of the rows.

2. The gas turbine combustor according to claim 1, wherein:

each of the air holes is formed obliquely in the air hole plate, each air hole having its central axis extending at a predetermined angle with respect to an axial direction of a combustor liner, and the plurality of grooves are formed to be situated on a downstream side in regard to an air discharge direction from the air holes.

3. The gas turbine combustor according to claim 2, wherein each of the plurality of grooves is formed for each of the air holes in a one-to-one correspondence.

4. A gas turbine combustor comprising:

a combustion chamber in which fuel is burned with air to generate combustion gas;

a fuel header having a plurality of fuel nozzles for discharging fuel;

an air hole plate provided with a plurality of air holes through which fuel discharged from the plurality of fuel nozzles and air are injected into the combustion chamber; and a groove formed on a surface of the air hole plate on a side of the combustion chamber, the groove being connected with the plurality of air holes;

wherein:

the groove is one of a plurality of grooves formed on the air hole plate, and a dimension of a gap formed by two adjacent ones of the plurality of grooves is set less than or equal to a flame quenching distance.

5. The gas turbine combustor according to claim 4, wherein:

the plurality of grooves are concentric circumferential grooves differing in a radius; and a dimension of the gap between two of the plurality of grooves adjacent to each other in a radial direction is set less than or equal to the flame quenching distance.

6. The gas turbine combustor according to claim 5, wherein:

none of the grooves are formed in a first region where a radial distance from a center of the air hole plate is less than a predetermined value, the first region including the air holes each having its open end on the combustion chamber's side situated on the air hole plate;

the grooves are formed in a second region where the radial distance from the center of the air hole plate is the predetermined value or more, the second region including the air holes each having its open end on the combustion chamber's side situated at a bottom of the grooves; and the air holes in the second region are larger in diameter than those of the air holes in the first region.

7. A gas turbine combustor comprising:

a combustion chamber in which fuel is burned with air to generate combustion gas;

a fuel header having a plurality of fuel nozzles for discharging fuel;

an air hole plate provided with a plurality of air holes through which fuel discharged from the plurality of fuel nozzles and air are injected into the combustion chamber; and a groove formed on a surface of the air hole plate on a side of the combustion chamber, the groove being connected with the plurality of air holes;

wherein:

each of the fuel nozzles is provided with a corresponding one of the air holes which is arranged downstream of the fuel nozzle in an axial direction of the fuel nozzle; and the fuel discharged from the each of the fuel nozzles and the air flowing through the corresponding one of the air holes form a coaxial jet.

* * * * *